US009168415B2

(12) United States Patent
Liu et al.

(10) Patent No.: US 9,168,415 B2
(45) Date of Patent: Oct. 27, 2015

(54) FOLDABLE TREADMILL

(71) Applicant: Dyaco International Inc., Taipei (TW)

(72) Inventors: Shih-Wei Liu, Taipei (TW); Hsuan-Fu Huang, Taipei (TW)

(73) Assignee: Dyaco International Inc., Taipei (TW)

( * ) Notice: Subject to any disclaimer, the term of this patent is extended or adjusted under 35 U.S.C. 154(b) by 125 days.

(21) Appl. No.: 14/070,456

(22) Filed: Nov. 1, 2013

(65) Prior Publication Data

US 2015/0087483 A1 Mar. 26, 2015

(30) Foreign Application Priority Data

Sep. 25, 2013 (TW) ..... 102134630 U

(51) Int. Cl.

| | |
|---|---|
| ***A63B 22/04*** | (2006.01) |
| ***A63B 22/00*** | (2006.01) |
| ***A63B 71/00*** | (2006.01) |
| ***A63B 22/02*** | (2006.01) |

(52) U.S. Cl.

CPC ..... *A63B 22/02* (2013.01); *A63B 2210/50* (2013.01)

(58) Field of Classification Search

CPC ..... A63B 22/02; A63B 22/0207; A63B 22/0214; A63B 22/0221; A63B 22/0228; A63B 22/0235; A63B 22/0285; A63B 2210/50

USPC ..... 482/51, 54

See application file for complete search history.

(56) References Cited

U.S. PATENT DOCUMENTS

| | | | | |
|---|---|---|---|---|
| 3,685,511 | A * | 8/1972 | Alvarez | 601/115 |
| 5,605,526 | A * | 2/1997 | Hatfield | 482/142 |
| 5,816,981 | A * | 10/1998 | Hung | 482/54 |
| 5,839,993 | A * | 11/1998 | Fox | 482/54 |
| 5,897,464 | A * | 4/1999 | Mcleod | 482/79 |
| 5,897,474 | A * | 4/1999 | Romero | 482/146 |
| 5,931,768 | A * | 8/1999 | Amesquita | 482/140 |
| 6,090,016 | A * | 7/2000 | Kuo | 482/54 |
| 6,383,120 | B1 * | 5/2002 | Lo | 482/54 |
| 6,421,935 | B1 * | 7/2002 | Bartlett | 36/132 |
| 6,857,991 | B2 * | 2/2005 | Yu | 482/54 |
| 6,890,287 | B2 * | 5/2005 | Chen | 482/54 |
| 6,916,277 | B2 * | 7/2005 | Chen | 482/54 |
| 6,979,283 | B2 * | 12/2005 | Pan et al. | 482/54 |
| 7,004,887 | B2 * | 2/2006 | Pan et al. | 482/54 |
| 2004/0132585 | A1 * | 7/2004 | Chen | 482/54 |
| 2006/0149174 | A1 * | 7/2006 | Fink | 601/121 |
| 2008/0103034 | A1 * | 5/2008 | Mihara et al. | 482/146 |
| 2009/0176635 | A1 * | 7/2009 | Brinson | 482/141 |
| 2010/0152007 | A1 * | 6/2010 | Le et al. | 482/148 |
| 2013/0130872 | A1 * | 5/2013 | Benne et al. | 482/121 |
| 2014/0378283 | A1 * | 12/2014 | Qiu | 482/142 |

* cited by examiner

*Primary Examiner* — Stephen Crow
*Assistant Examiner* — Garrett Atkinson
(74) *Attorney, Agent, or Firm* — Donald E. Stout; Stout, Uxa & Buyan, LLP

(57) ABSTRACT

A foldable treadmill includes a base for running or walking, a frame set pivotally connected with the base, and a folding mechanism for folding the frame set. The folding mechanism has a control assembly and a sliding rod connected with the frame set and capable of being locked or released by the control assembly. When the control assembly locks the sliding rod at a first position, the frame set cannot be rotated, and when the control assembly releases the sliding rod, the frame set can be rotated to a storage position thus pulling the sliding rod to a second position.

9 Claims, 11 Drawing Sheets

FOLDABLE TREADMILL

CROSS-REFERENCE TO RELATED APPLICATIONS

The entire contents of Taiwan Patent Application No. 102134630, filed on Sep. 25, 2013, from which this application claims priority, are incorporated herein by reference.

BACKGROUND OF THE INVENTION

1. Field of the Invention

The present invention relates to training machines, and more particularly relates to foldable treadmills.

2. Description of Related Art

Nowadays, people tend to lack adequate exercise due to busy lifestyles. To the extent running has become popular as a simple and effective means for squeezing physical activity into a tight schedule, it is not always practicable. When the weather is bad or during particular times (such as at night), running on a treadmill can be more convenient as compared to being outside.

A conventional treadmill, however, may suffer from being too large and thus inconvenient for regular usage which may require frequent commissioning of the device in and out of storage.

Prior treadmills, such as disclosed in Taiwan Patents I303571 and M339319, have sought to advance usability by providing foldability for enabling storage of the treadmills. Yet, the folding mechanisms of the resulting assemblies still have some deficiencies in need of improvement.

SUMMARY OF THE INVENTION

In one general aspect, the present invention relates to foldable treadmills featuring compact folded sizes and easy, fast folding manners of use.

In an embodiment of the present invention, a foldable treadmill is provided with a base on which a user walks or runs in place, a frame set pivotally connected with the base, and a folding mechanism having a control assembly and a sliding rod with an end being connected with the frame set. The sliding rod is capable of being locked or released by the control assembly; when the control assembly locks the sliding rod at a first position, the frame set cannot be rotated, and when the control assembly releases the sliding rod. The frame set can be rotated to a storage configuration, thus pulling the sliding rod to a second position.

In another embodiment of the present invention, a foldable treadmill is formed with a base on which a user can walk or run in place, a frame set pivotally connected with the base and having a first post and a second post, and a folding mechanism comprising a first control assembly and a second control assembly. The first folding mechanism comprises a first control assembly and a first sliding rod with an end being connected with the frame set, wherein the first sliding rod is capable of being locked or released by the first control assembly. The second folding mechanism comprises a second control assembly and a second sliding rod with an end being connected with the frame set, wherein the second sliding rod is capable of being locked or released by the second control assembly. When the first control assembly locks the first sliding rod at a first position, and the second control assembly locks the second sliding rod at a first position, the frame set cannot be rotated, and when the first control assembly releases the first sliding rod, and the second control assembly releases the second sliding rod, the frame set can be rotated to a storage configuration which pulls the first sliding rod and the second sliding rod to a second position.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1:
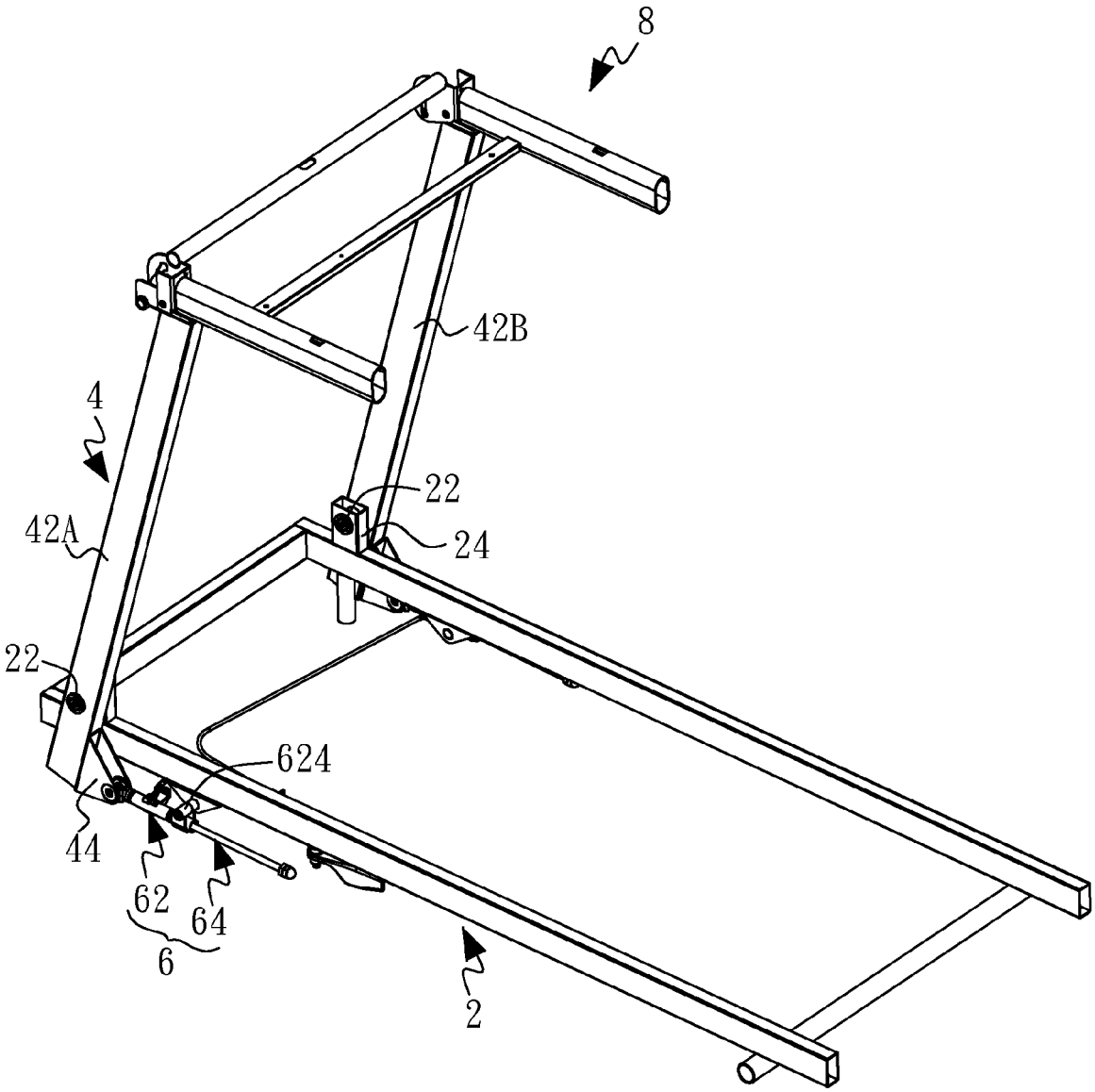
FIG. 1 is a front view showing a foldable treadmill according to a preferred embodiment of the present invention.

FIGS. 1-9 show a foldable treadmill according to a preferred embodiment of the present invention. As shown in FIG. 1, the foldable treadmill mainly includes a base 2, a frame set 4, and a folding mechanism 6.

The base 2 is used for running or walking on it. The frame set 4 pivotally connects with the base 2. In this context, the pivotal connection of two components may be direct or indirect. For example, the frame set 4 may pivotally connect with the base 2 through a shaft 22, which may be arranged at the base 2 or a block 24 above the base 2, so that the frame set 4 can rotate around the shaft 22. In other embodiments of this invention, the shaft 22 can be arranged at other positions, for example, at the front end of the base 2 or a part extending from the front end of the base 2. For a person skilled in the art, alternatives, modifications, and equivalents may be made for the above-mentioned configuration, and those alternatives, modifications, and equivalents are within the scope of the present invention.

Figure 8:
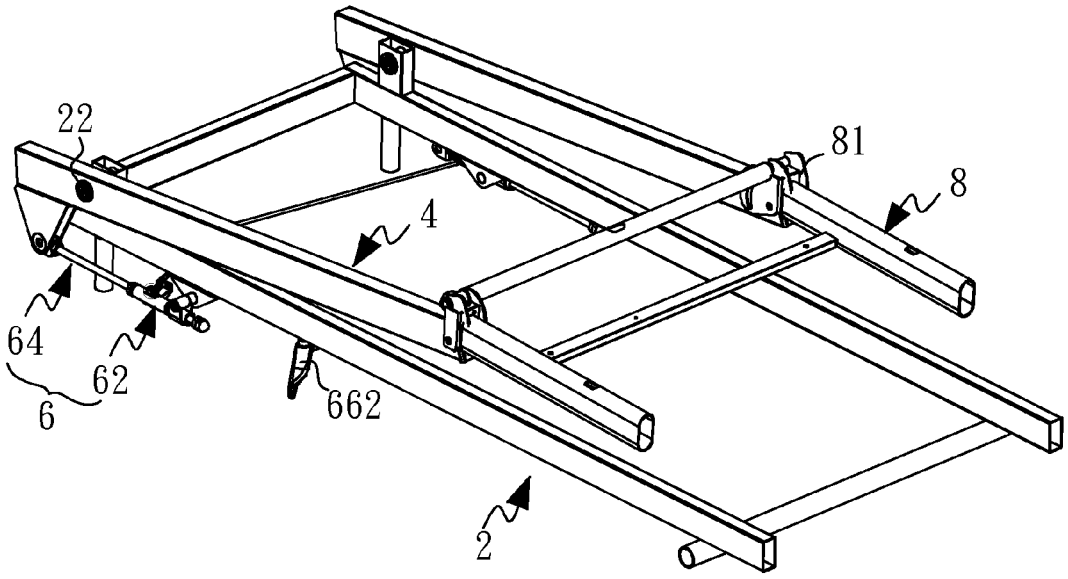
FIG. 8 is a front view showing the foldable treadmill in a storage configuration according to the preferred embodiment of the present invention.

FIG. 1 shows the frame set 4 in an operable configuration, in which an angle present between the frame set 4 and the base 2. FIG. 8 shows that the frame set 4 is rotated to a storage configuration, so that the frame set 4 is nearly overlap the base 2.

In this embodiment, the frame set 4 is arranged outside of the base 2. In another embodiment, the frame set 4 may be arranged inside of the base 2.

The folding mechanism 6 mainly includes a control assembly 62 and a sliding rod 64. One end of the sliding rod 64 connects with the frame set 4, and the control assembly 62 is used to lock or release the sliding rod 64. As shown in FIG. 1, when the control assembly 62 locks the sliding rod 64 at a first position, the frame set 4 cannot be rotated. As shown in FIG. 8, when the control assembly 62 releases the sliding rod 64, the frame set 4 can be rotated to a storage configuration thus pulling the sliding rod 64 to a second position. The detail of the structure and operation will be discussed as follows.

Figure 2A:
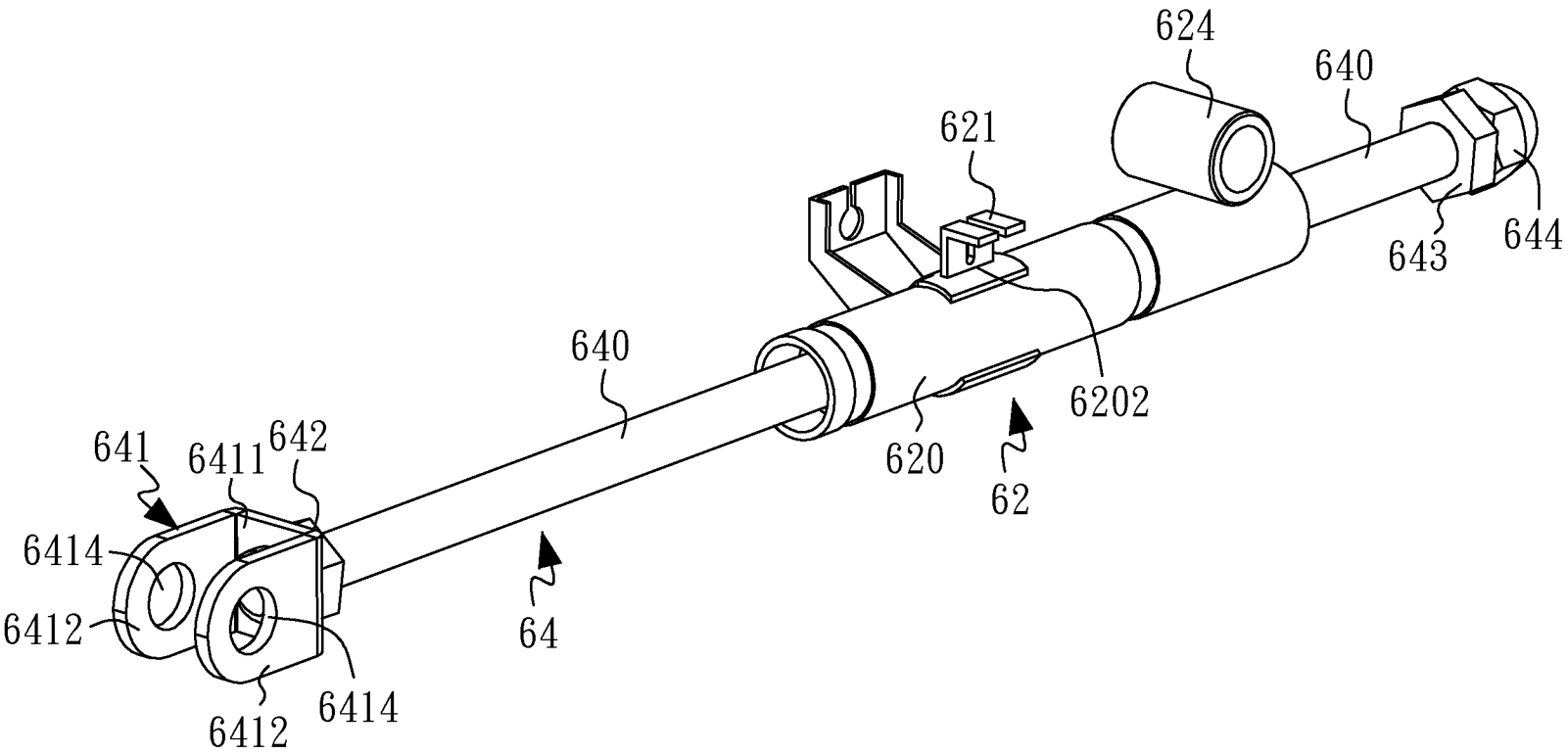
FIGS. 2A-2C are assembled view, exploded view, and cross-sectional type view, respectively, showing a control assembly and a sliding rod of the foldable treadmill.
Figure 2B:
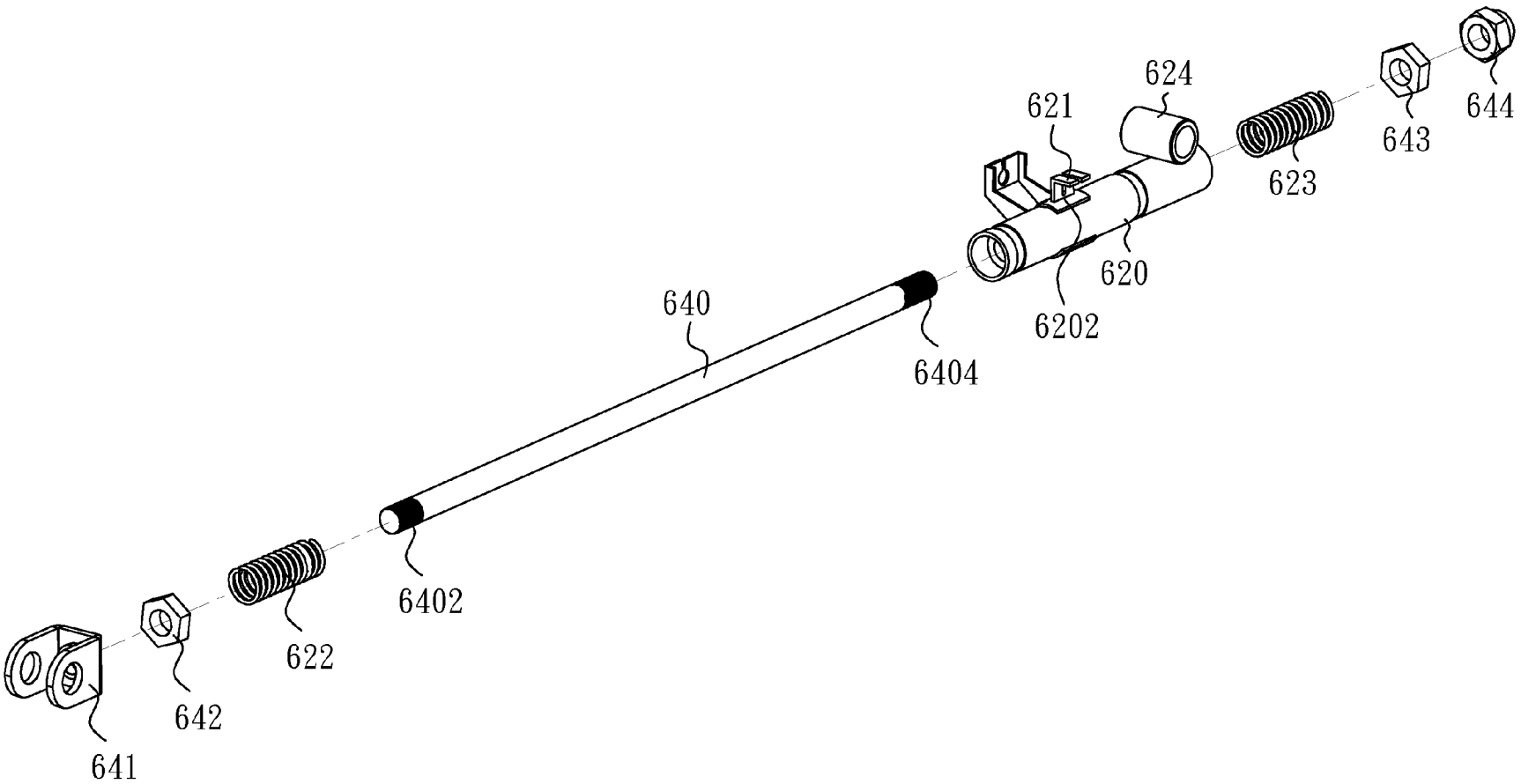
Figure 2C:
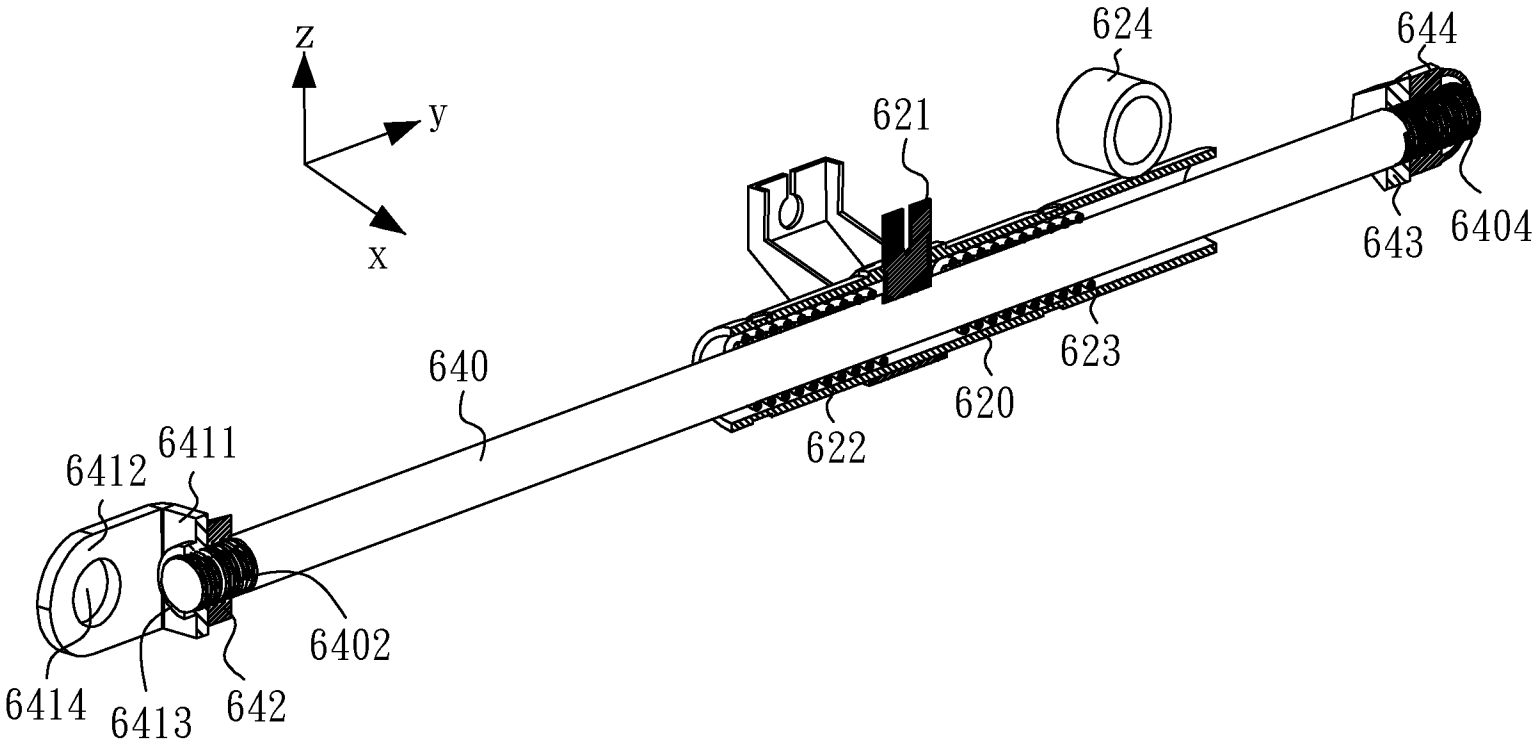

FIGS. 2A-2C show the control assembly 62 and the sliding rod 64 of the foldable treadmill of the preferred embodiment, in which FIG. 2A is a front view, FIG. 2B is a exploded view, and FIG. 2C is a cross-sectional type view. The control assembly 62 comprises a tube 620, a fixing member 621, a first torsion spring 622, and a second torsion spring 623. The sliding rod 64 mainly includes a stick 640.

The first torsion spring 622, the second torsion spring 623, and a portion of the stick 640 are arranged within the tube 620. The sidewall of the tube 620 has an opening 6202. The fixing member 621 touches the stick 640 and a portion of the fixing member 621 extends out of the opening 6202. The stick 640 of the sliding rod 64 passes through the first torsion spring 622 and the second torsion spring 623. One end of the first torsion spring 622 fixes with the inner wall of the tube 620, and the other end of the first torsion spring 622 fixes with the fixing member 621, so that the first torsion spring 622 can provide the fixing member 621 with a clockwise torsion in the xz plane. The torsion can press the fixing member 621 against the stick 640 and thus lock the stick 640. Similarly, one end of the second torsion spring 623 fixes with inner wall of the tube 620, and the other end of the second torsion spring 623 fixes with the fixing member 621, so that the second torsion spring 623 can provide the fixing member 621 with a clockwise torsion in the xz plane. The torsion can press the fixing member 621 against the stick 640 and thus lock the stick 640. When the fixing member 621 is pressed against the stick 640, the stick 640 cannot be moved. When a force is exerted to pull the fixing member 621 leaving the stick 640, the stick 640 can be slid within the inner wall 620. In another embodiment of this invention, one of the two torsion springs (622/623) can be omitted.

According to the preferred embodiment of this invention, the tube 620 fixes with the base 2, and one end of the sliding rod 64 connects or pivotally connects with the frame set 4. Therefore, when the fixing member 621 is pressed against the sliding rod 64, the frame set 4 cannot rotate, and when the fixing member 621 leaves the sliding rod 64, the frame set 4 can rotate and can draw the sliding rod 64 moving. The detail is discussed as follows.

To connect or pivotally connect the frame set and one end of sliding rod 64, the sliding rod 64 may further comprise a U-shaped member 641 and a nut 642. To fix the tube 620 and the base 2, the control assembly 62 may further comprise a column 624. To limit the displacement of the stick 640, the sliding rod 64 may further comprise a nut 643 and a cap nut 644.

Figure 3A:
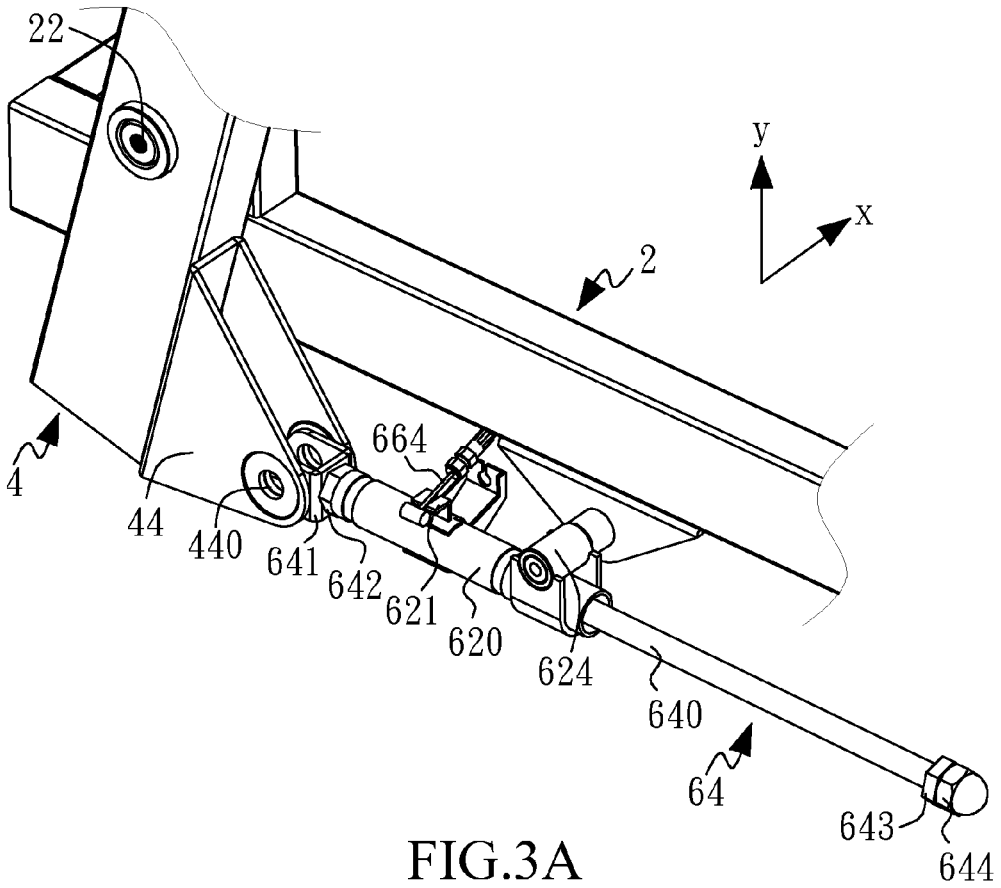
FIGS. 3A and 3B are a partially enlarged view and a partially enlarged bottom view, respectively, showing the foldable treadmill in an operable configuration.
Figure 3B:
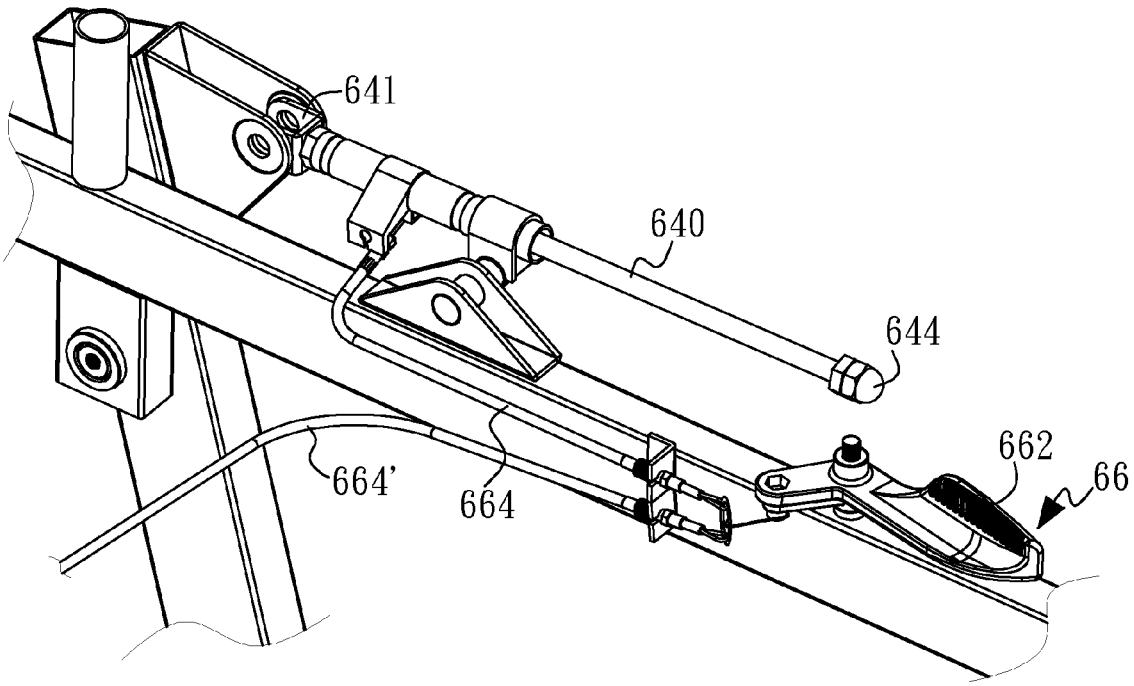

FIGS. 3A and 3B are a partially enlarged view and a partially enlarged bottom view, respectively, showing the foldable treadmill in an operable configuration. In such configuration the frame set 4 cannot be rotated, and the sliding rod 64 is at a first position. Turning to FIGS. 2A-2C and 3A-3B, one end of the stick 640 has a thread 6402, and a hole 6413 of a bottom surface 6411 of the U-shaped member 641 has thread corresponding to thread 6402, so that one end of the stick 640 can fix with the nut 642 and the U-shaped member 641. Additionally, the other end of the stick 640 has a thread 6404, so that it can fix with the nut 643 and the cap nut 644.

In addition, two side walls 6412 of the U-shaped member 641 respectively has a bore 6414, and the frame set 4 may further comprise a triangular member 44 with a shaft 440 corresponding to the bores 6414 of the U-shaped member 641, so that the U-shaped member 641, i.e., an end of the sliding rod 64, can pivotally connect with triangular member 44 of the frame set 4. Further, the tube 620 may employ the column 624 to fix with the base 2. As shown in FIG. 3A, when the fixing member 621 is pressed against the stick 640, the sliding rod 64 cannot be moved, and therefore the frame set 4 cannot rotate around the shaft 22. Such configuration is defined as a first position for the sliding rod 64.

To raise the fixing member 621 leaving the sliding rod 64, a force must be exerted to cancel the torsion provided by the first and second torsion spring 622/623. As shown in FIGS. 3A-3B, the folding mechanism 6 may further comprise an operation assembly, which comprises a handle 662 and a cable 664. One end of the cable 664 connects with the handle 662, and the other end of the cable 664 connects with the fixing member 621. The cable 664 may comprise, but is not limited to, steel rope.

Figure 4:
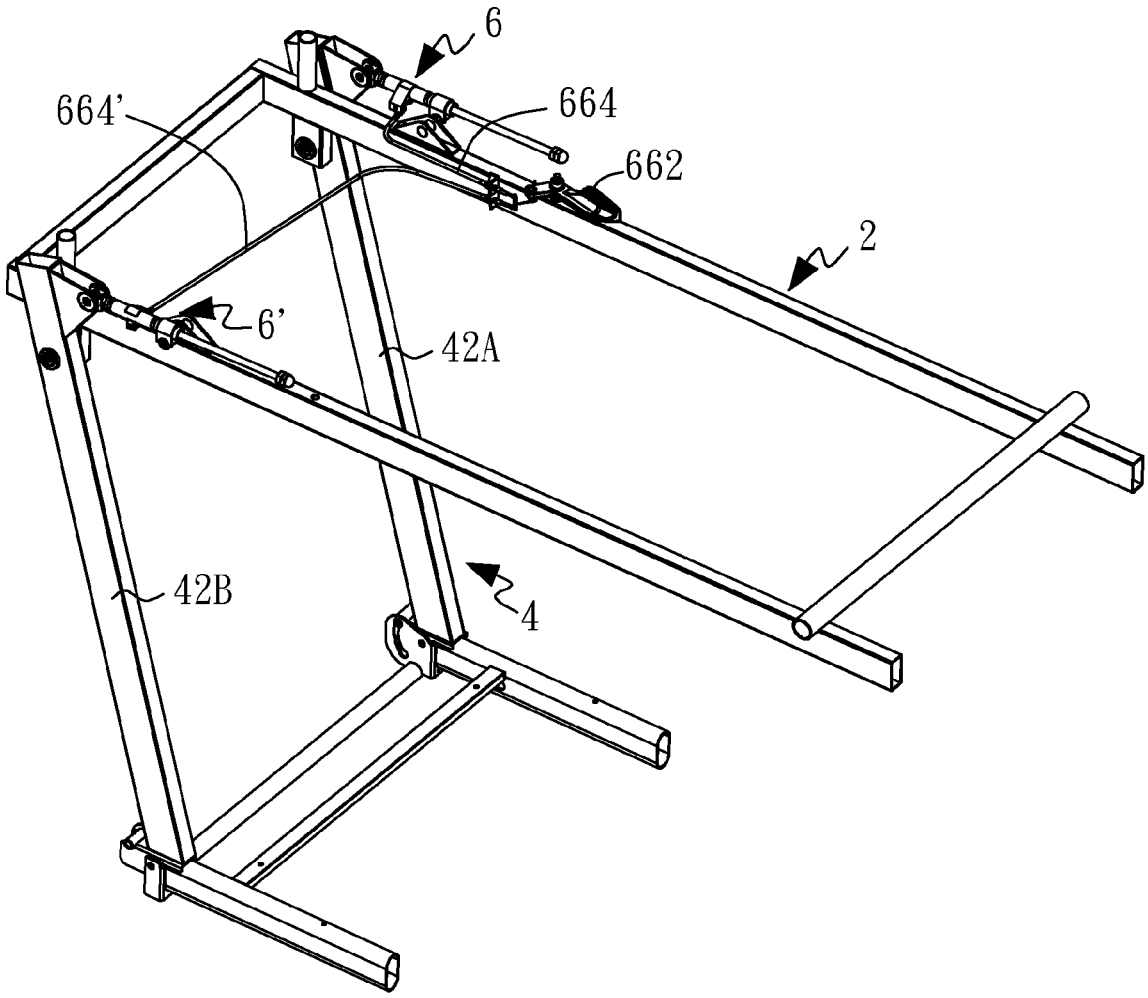
FIG. 4 is a bottom view showing the foldable treadmill in the operable configuration according to the preferred embodiment of the present invention.

FIG. 4 is a bottom view showing the foldable treadmill in the operable configuration according to the preferred embodiment of the present invention. In this embodiment, the frame set 4 may comprise a first post 42A and a second post 42B, and the foldable treadmill may comprise two folding mechanism 6/6' arranged at the bottom of two sides of the base 2. The handle 662 connects with the cable 664 and cable 664' so as to respectively control the folding mechanism 6 and the folding mechanism 6'. In another embodiment of this invention, the folding mechanism 6' and the cable 664' may be omitted.

Figure 5:
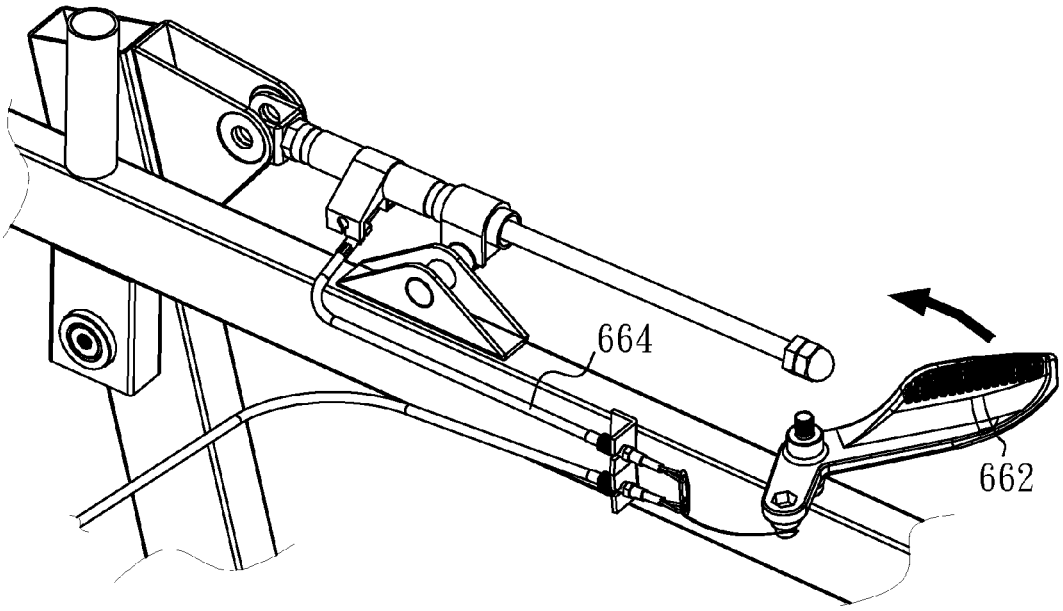
FIGS. 5 and 6 show folding procedure of the foldable treadmill according to the preferred embodiment of the present invention.
Figure 6:
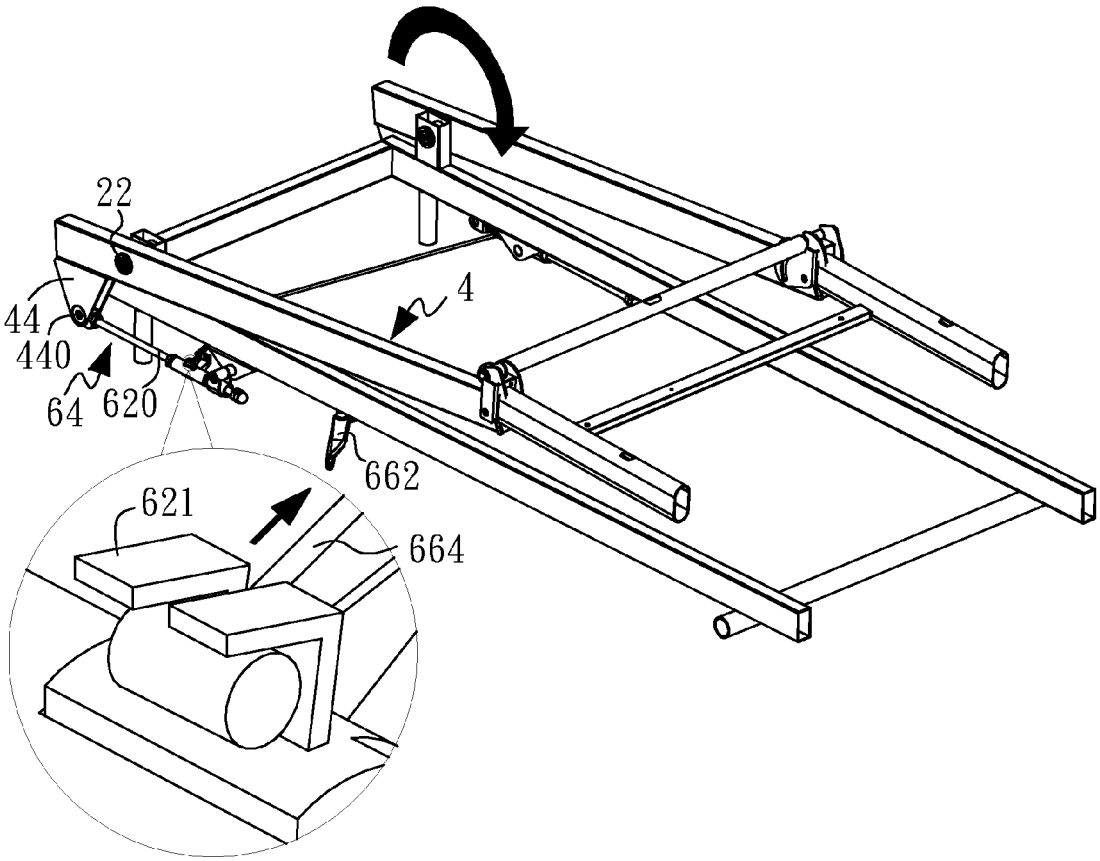

FIGS. 5 and 6 show a folding procedure of the foldable treadmill according to the preferred embodiment of the present invention. As shown in FIG. 5, when the user turns the handle 662, the cable 664 will pull the fixing member 621 leaving the sliding rod 64 in the direction of arrow shown in the drawing, so that the sliding rod 64 can be moved within the tube 620. As shown in FIG. 6, the frame set 4 is no longer bound by the sliding rod 64 at this time, so that the frame set 4 can be rotated around the shaft 22 and folded to the storage configuration.

Figure 7:
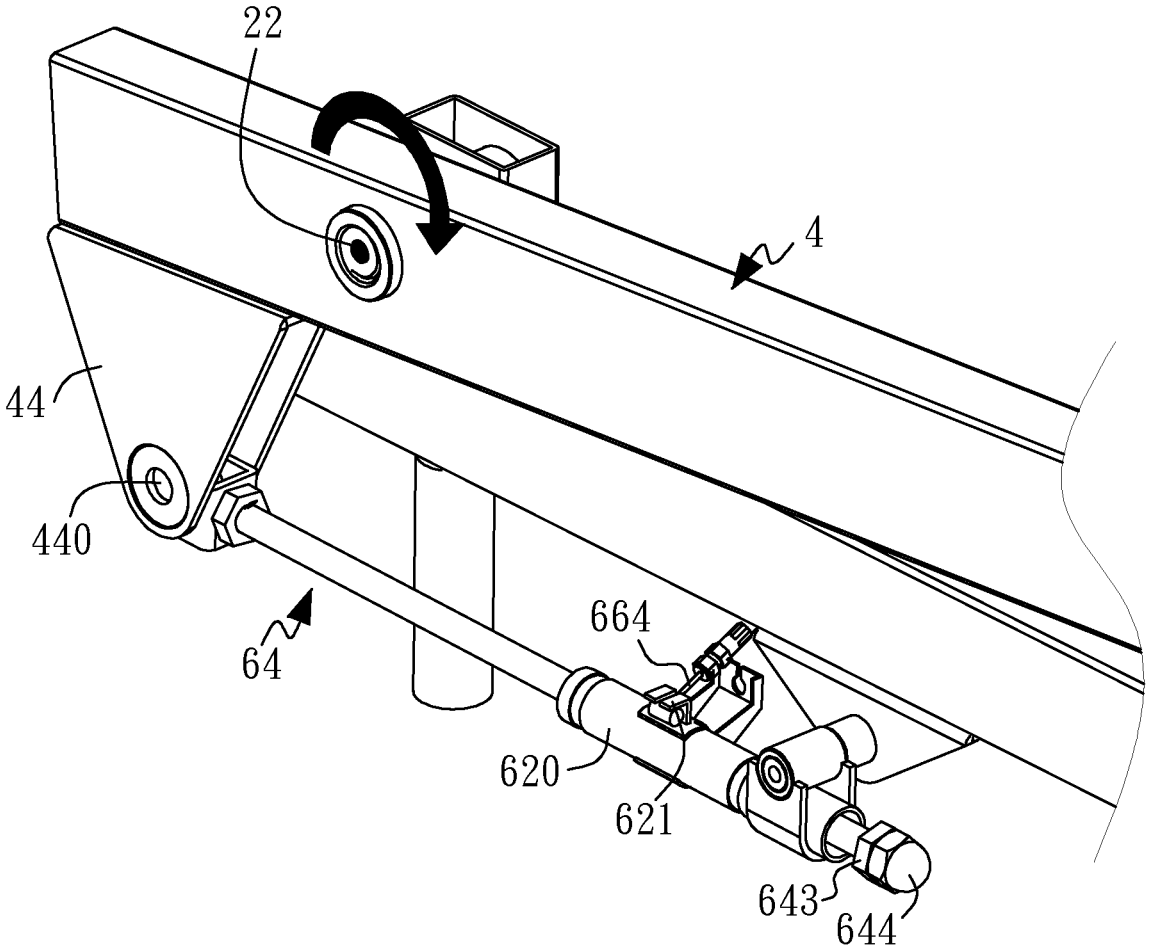
FIG. 7 is a partially enlarged view showing the foldable treadmill in a storage configuration according to the preferred embodiment of the present invention.

FIG. 7 is a partially enlarged view showing the foldable treadmill in the storage configuration according to the preferred embodiment of the present invention. The frame set 4 is folded to the storage configuration, and drags the sliding rod 64 moving forward to a second position through the triangular member 44. The nut 643 and cap nut 644 are used to limit the displacement of the sliding rod 64.

FIG. 8 is a front view showing the foldable treadmill in the storage configuration according to the preferred embodiment of the present invention. In this embodiment, the foldable treadmill may further comprise an operation panel 8 and a folding mechanism 81. The operation panel 8 connects with the frame set 4 and the folding mechanism 81 is used to fold the operation panel 8. In another embodiment of this invention, the foldable treadmill may not include the operation panel 8 and the folding mechanism 81. In addition, the configuration of the folding mechanism 81 is not limited; it could be same as any other folding mechanisms provided by the assignee of the present application, such as the folding mechanism disclosed in Taiwan patent M432443, the entire contents of which is incorporated herein by reference.

Figure 9:
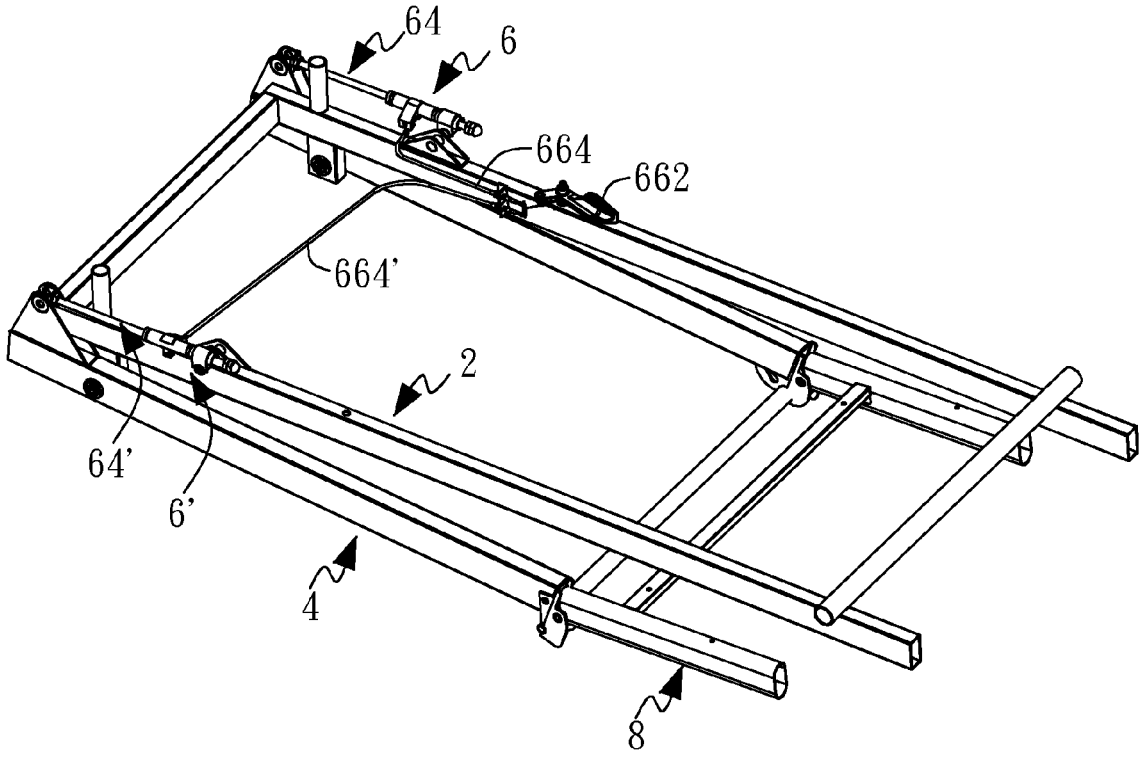
FIG. 9 is a bottom view showing the foldable treadmill in a storage configuration according to the preferred embodiment of the present invention.

FIG. 9 is a bottom view showing the foldable treadmill in the storage configuration according to the preferred embodiment of the present invention. As shown in FIG. 9, the user turns the handle 662 to simultaneously control the folding mechanism 6 and the folding mechanism 6', so that the sliding rod 64 and the sliding rod 64' are moved to the second position.

Figure 10A:
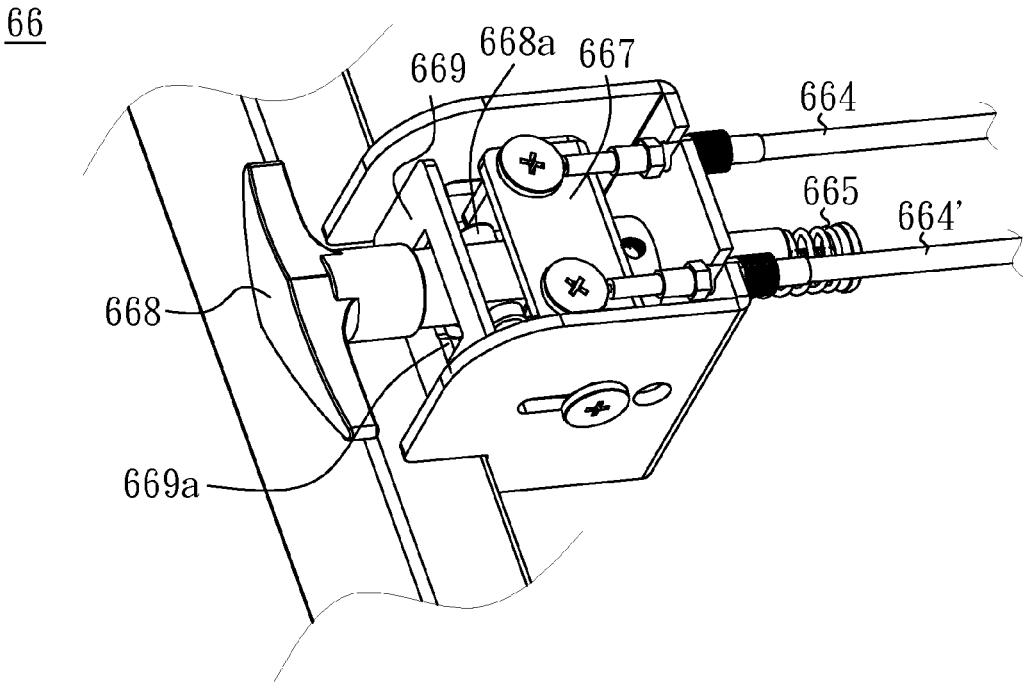
FIGS. 10A-10C show an operation assembly according to another embodiment of the present invention.
Figure 10B:
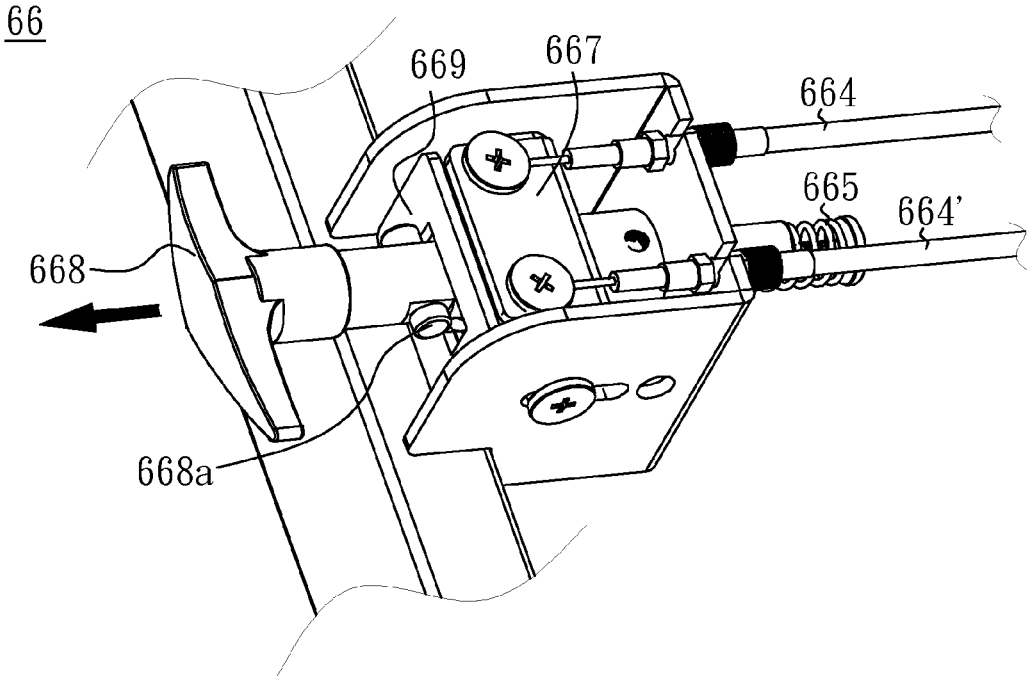
Figure 10C:
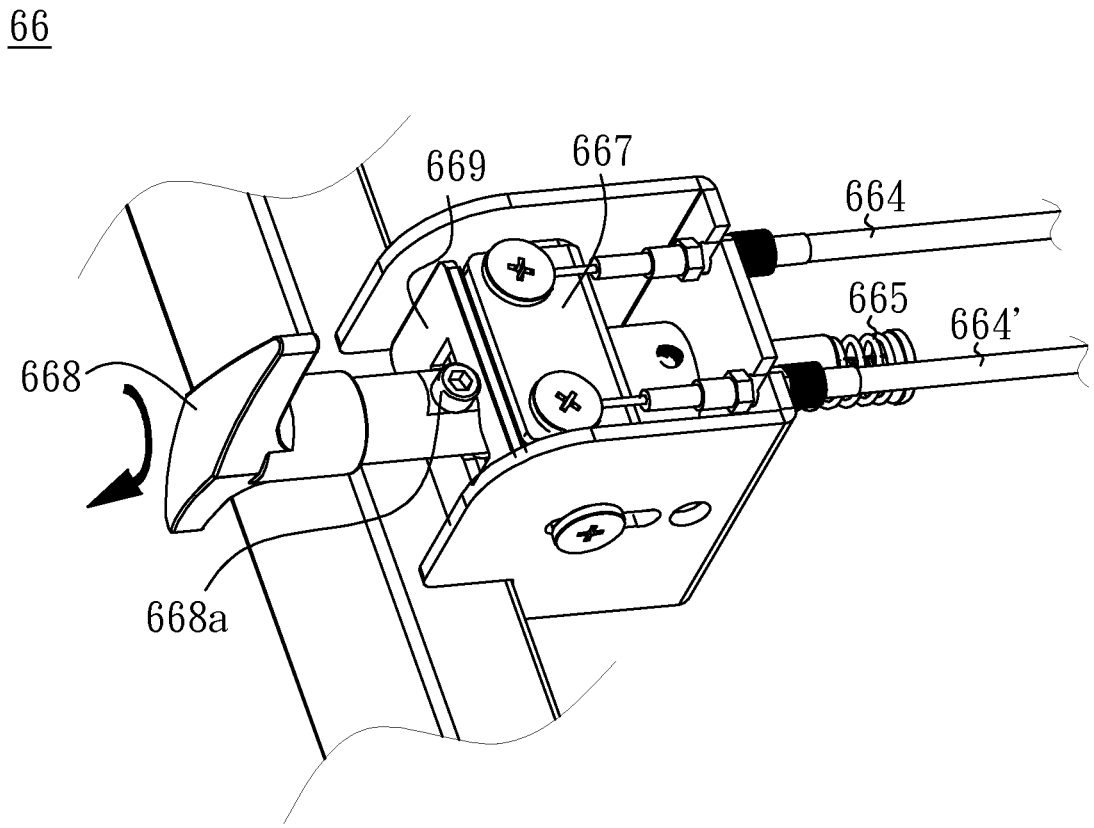

FIGS. 10A-10C show an operation assembly according to another embodiment of the present invention. The difference between this and the forgoing embodiment is that, the handle 662 of the forgoing embodiment is replaced by a puller 668. In addition, the operation assembly 66 further comprises a housing 669, a bench 667, and a spring 665. The bench 667 is arranged within the housing 669 and can be moved within the housing 669. One end of the puller 668 passes through an opening 669*a* of the housing 669, and fixes with the bench 667 and the spring 665. One end of the cable 664 and the cable 664' connects with the bench 667, and the other end connects with the fixing member 621. As shown in FIG. 10B, when the user pulls the puller 668 to drag the cable 664 and the cable 664', so as to release the sliding rod 64/64' of the folding mechanism 6/6'. As shown in FIG. 10C, the user may turn the puller 668 to lodge a baton 668*a* of the puller 668 in an opening 669*a* of the housing, so that the puller 669 will not return to the position as shown in FIG. 10A.

Accordingly, embodiments of this invention provide foldable treadmills featuring a compact folded size and a convenient, fast folding manner.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A foldable treadmill, comprising:

a base for running or walking;

a frame set pivotally connected with the base; and a first folding mechanism, comprising:

a control assembly; and a sliding rod with an end being connected with the frame set;

wherein the sliding rod is capable of being locked or released by the control assembly; when the control assembly locks the sliding rod at a first position, the frame set cannot be rotated, and when the control assembly releases the sliding rod, the frame set can be rotated to a storage configuration whereby the sliding rod is pulled to a second position; and wherein the control assembly comprises:

a tube, having a side wall with an opening, a portion of the sliding rod being arranged within the tube;

a fixing member, passing through the opening of the tube and contacting with the sliding rod; and at least a torsion spring having a first end and a second end, the sliding rod passing through the torsion spring, wherein the first end of the torsion spring connects with the inner wall of the tube, and the second end of the torsion spring connects with the fixing member, so that the torsion spring provides a torsion to press the fixing member against the sliding rod and thus lock the sliding rod.

2. The foldable treadmill as set forth in claim 1, wherein the end of the sliding rod pivotally connects with the frame set.

3. The foldable treadmill as set forth in claim 2, wherein the frame set fixes with a triangular member, and the end of the sliding rod pivotally connects with a shaft of the triangular member.

4. The foldable treadmill as set forth in claim 1, wherein the control assembly comprises two torsion springs respectively arranged at a right side and a left side of the fixing member.

5. The foldable treadmill as set forth in claim 1, wherein the end of the sliding rod pivotally connects with the frame set, and the other end of the sliding rod comprises a cap nut to limit the displacement of the sliding rod.

6. The foldable treadmill as set forth in claim 1, wherein the first folding mechanism further comprising:

a handle or a puller; and a cable having one end connecting with the handle and the other end connecting with the fixing member;

wherein the handle or the puller provides a force to cancel the torsion of the torsion spring, so that the sliding rod is released.

7. The foldable treadmill as set forth in claim 1, further comprising a second folding mechanism having the same components as the first folding mechanism, the first folding mechanism and the second folding mechanism being arranged at a left side and a right side of the base, respectively.

8. A foldable treadmill, comprising:

a base for running or walking;

a frame set comprising a first post and a second post pivotally connected with the base, respectively;

a first folding mechanism, comprising a first control assembly and a first sliding rod with an end being connected with the frame set, wherein the first sliding rod is capable of being locked or released by the first control assembly; and a second folding mechanism, comprising a second control assembly and a second sliding rod with an end being connected with the frame set, wherein the second sliding rod is capable of being locked or released by the second control assembly;

wherein the frame set cannot be rotated when the first control assembly locks the first sliding rod at a first position and the second control assembly locks the second sliding rod at a first position, and wherein the frame set can be rotated when the first control assembly releases the first sliding rod and the second control assembly releases the second sliding rod, such that the frame set is rotated to a storage configuration corresponding to movement of the first sliding rod and the second sliding rod to a second position; and wherein the first control assembly comprises:

a first tube, having a side wall with an opening, a portion of the first sliding rod being arranged within the first tube;

a first fixing member, passing through the opening of the first tube and contacting with the first sliding rod; and at least a first torsion spring having a first end and a second end, the first sliding rod passing through the first torsion spring, wherein the first end of the first torsion spring connects with the inner wall of the first tube, and the second end of the first torsion spring connects with the first fixing member, so that the first torsion spring provides a torsion to press the first fixing member against the first sliding rod and thus lock the first sliding rod.

9. The foldable treadmill as set forth in claim 8, wherein the end of the first sliding rod and the end of the second sliding rod pivotally connect with the frame set.

* * * * *